United States Patent [19]

Carvalho

[11] Patent Number: 4,998,515

[45] Date of Patent: Mar. 12, 1991

[54] INTERNAL COMBUSTION ENGINE TIMING CHAIN COVER

[75] Inventor: Americo Carvalho, Huntington Woods, Mich.

[73] Assignee: KCR Engine Automotive Parts, Inc., Huntington Woods, Mich.

[21] Appl. No.: 511,718

[22] Filed: Apr. 20, 1990

[51] Int. Cl.[5] ..... F02F 7/00

[52] U.S. Cl. ..... 123/195 C; 123/198 E

[58] Field of Search ..... 123/195 C, 198 E; 277/9, 9.5, 10, 178

[56] References Cited

U.S. PATENT DOCUMENTS

| | | | |
|---|---|---|---|
| 4,257,370 | 3/1981 | Kasting | 123/195 C |
| 4,265,495 | 5/1981 | Bachlin | 123/195 C |
| 4,480,609 | 11/1984 | Hayashi | 123/195 C |
| 4,607,601 | 8/1986 | Kohler | 123/90.31 |
| 4,883,031 | 11/1989 | Ampferer et al. | 123/198 E |
| 4,920,825 | 5/1990 | Okazaki et al. | 123/195 C |

FOREIGN PATENT DOCUMENTS

| | | | |
|---|---|---|---|
| 3141627 | 6/1982 | Fed. Rep. of Germany | 123/195 C |
| 0259727 | 12/1985 | Japan | 123/195 C |
| 0255249 | 11/1986 | Japan | 123/195 C |
| 0032151 | 2/1988 | Japan | 123/195 C |

*Primary Examiner*—David A. Okonsky
*Assistant Examiner*—Weilun Lo
*Attorney, Agent, or Firm*—Harness, Dickey & Pierce

[57] ABSTRACT

A cover for use on the forward, timing chain, end of a number of different model multi-cylinder, automotive vehicle type internal combustion engines is formed of an integral cast metal dish-like shape having a forward wall and a surrounding edge wall which define a cavity. The edge wall is shaped to engage and mount upon the forward end of an engine to cover the timing chain and the engine crankshaft extends through a seal mounted within a hole in the wall, with the seal being located upon the exterior of the cover wall for removal without removing the cover. A fuel pump mounting opening, which may be blocked by a removable plate, is formed in the cover edge wall so that a fuel pump may be optionally mounted within the cover by removing the plate. A distributor mechanism receiving opening is formed in the upper end portion of the cover edge wall and alternative screw receiving holes formed in the cover permit mounting different, preselected distributor mechanisms therein. A triangular shaped base is formed integral with the lower end of the cover for fastening different shaped oil pans thereon.

11 Claims, 2 Drawing Sheets

INTERNAL COMBUSTION ENGINE TIMING CHAIN COVER

BACKGROUND OF INVENTION

This invention relates to an improved, cast metal cover which may be mounted upon the forward end of a number of different internal combustion, automotive vehicle engines so as to reduce the number of different cover and cover elements previously used.

Multi-cylinder, internal combustion, automotive vehicle engines typically include a forward end upon which the engine timing gear mechanism is located. In addition, the engine distributor mechanism, the engine oil pump mechanism and the engine fuel pump mechanism may be mounted on the front end of the engine. Also, the engine crankshaft extends through the forward end of the block and is mounted within a bearing located at the forward end of the engine. Because engine configurations and the types of the above mechanisms differ, from engine to engine, it has been necessary in the past to have different cast metal covers and, sometimes, covers formed of a number of different parts, for enclosing the forward end of the engine and for mounting the various elements thereon.

By way of example, a current model six cylinder internal combustion engine and eight cylinder combustion engine used on General Motors "Buick" vehicles, while of generally similar size and configuration, require different covers and cover elements for the forward ends of the engines for covering the timing chain mechanisms located thereon. In addition, different fuel systems, distributor mechanisms, etc. require different covers for the same basic engine. In the large scale production of engines, which is common in the automotive manufacturing business, the fact that the engine covers must be different to accommodate different engines is of minimal significance because of the scale of production. However, in rebuilding engines or repairing engines, the shops involved must obtain or stock large numbers of different engine covers and engine cover parts in order to accommodate the particular job worked on at any particular time. Hence, the proliferation of engine covers requires substantial inventorying and expenses for engine rebuilders. In addition, delays are frequently encountered because of the need to locate and obtain a particular cover needed for a specific engine.

In the example mentioned above, it is necessary to use about seven different covers to accommodate the two engines mentioned and the different mechanisms each engine may use. Thus, it would be desirable to have a single cover which can be generically used for different engines of the same general size and shape in order to reduce the number of different cover and cover parts otherwise required. That would permit car dealers and engine rebuilders to stock, for example, one cover which can be used for a number of different engines and engine mechanisms and eliminate the need to inventory or otherwise obtain a variety of engine covers when needed.

As mentioned, the need for additional covers is exacerbated by the fact that a single engine may have different kinds of distributor systems and fuel pump mountings, oil pans and oil pump arrangements, each of which requires a different cover modification. It would be desirable to have a single cover which could be adapted to accommodate to the different mechanisms without any substantial modifications of the covers.

Moreover, in a typical engine, the front end cover which is positioned over the engine timing chain mechanism and over the forward end of the crankshaft, has to be removed in order to replace the front bearing used with the crankshaft. That is, where a crankshaft forward bearing leaks or is otherwise improperly functioning, a considerable amount of labor and time is required to remove the front end cover of the engine in order to obtain access to the bearing for removing and replacing it. Consequently, it would be desirable to mount the seal, along with the front end cover of the engine, in a manner which permits replacement of the seal without disassembly of the engine cover.

This invention, therefore, relates to an improved cast metal cover for fitting over the forward end of an engine for covering the timing chain mechanism and for permitting the mounting of different types of ancillary parts upon the engine, with the cover being somewhat generic in that it may be used on a number of different engines and with different engine accessories.

SUMMARY OF INVENTION

This invention relates to a single, unitary, cast metal cover which is bowl-like or dish-like in shape so as to provide a forward wall, surrounded by integral side walls to provide a closed cavity at the front of the engine when the cover is mounted upon the forward end of the engine block over the timing chain mechanism. The cover is formed in a somewhat generic manner in that it may be utilized with different engine accessories, such as different fuel pump and distributor mechanisms and the like accessories without modifying the cover.

Also, the cover includes means for mounting the forward crankshaft seal on the outside of the cover so that the seal may be removed and replaced without removing the cover from the engine. In addition, the cover construction includes a distributor mounting opening arrangement in the edge wall of the cover which permits mounting alternative distributor means within the opening. The cover is provided with alternative screw receiving holes for attaching different conventional distributor mechanisms. In addition, the cover includes a fuel pump mounting arrangement which is normally blocked or sealed by a cover plate. This plate is manually removable for insertion of a fuel pump mechanism into the cavity defined by the cover, or alternatively, is left in place for blocking the cover, to permit utilization of a different fuel delivery system, such as a fuel injection system, located on another part of the engine. Moreover, the cover includes a mounting base which is triangularly shaped so as to enable it to be fitted to different shaped oil pans located beneath the engine. Further, the construction permits the use of an integral oil pump housing, that is, formed integral with the cover and with enlarged oil passageways for increasing the flow of oil through the cover and cavity.

An overall objective of this invention is to adapt a conventional single engine and accessory configuration cover for more universal or generic use. This reduces the number of different covers and cover parts previously needed for generally similar, but different in detail, internal combustion engines so as to reduce the inventory of covers and to enable one cover to function in the place of a number.

Another object of this invention is to provide a simplified, strengthened, cover which may be easily used in engine rebuilding or repair and which is somewhat generic in its construction in that it can be used on different engine constructions with different engine accessories.

Still a further object of this invention is to reduce the expense, the time delays in engine rebuilding, and the inconvenience normally associated with obtaining and inventorying numerous engine chain and accessory covers by providing a single cover construction which may be used on a variety of different engine situations.

An additional object of this invention is to permit the engine rebuilder to reduce costs and reduce handling by reducing the number of parts required and making it more likely that the part that he needs will be available to him when needed. By requiring less inventory of parts, the inventory investment and handling costs for inventories reduced. Similarly, reducing the number of parts also reduces the labor costs for obtaining required parts and the labor costs for installing the parts. Also, fewer parts need be removed and reinstalled by the engine rebuilder.

These and other objects and advantages of this invention will become apparent upon reading the following description of which the attached drawings form a part.

DETAILED DESCRIPTION

Figure 1:
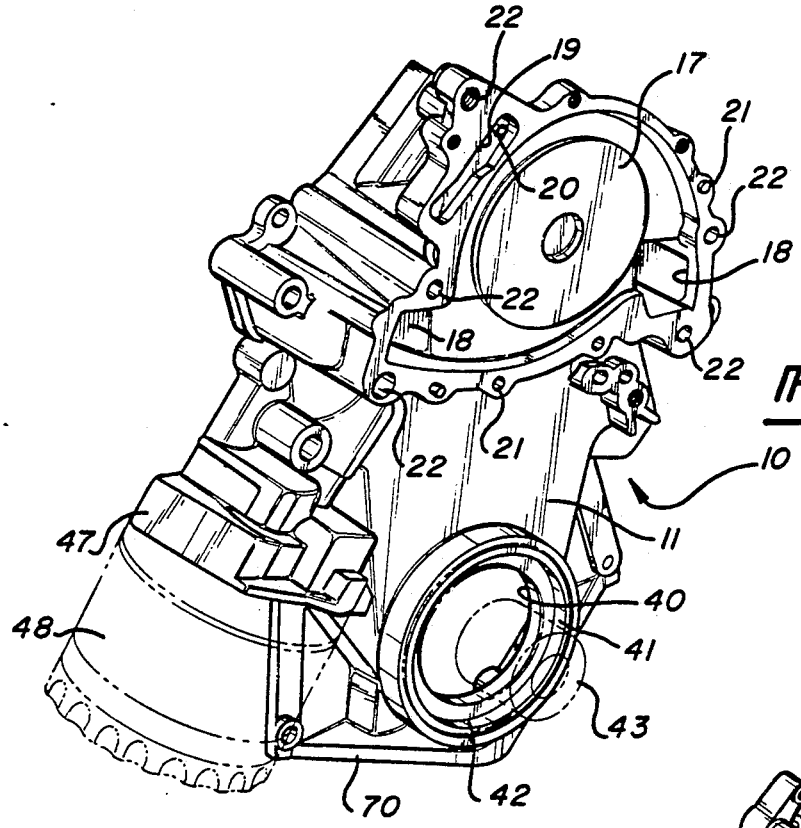
FIG. 1 is a perspective view of the forward portion of the cover.

The cover, generally designated 10, is provided with a forward wall portion 11 surrounded by a flange which forms an edge wall 12. The cover is generally dish-like or bowl-like in shape so as to provide an interior cavity 13, which receives the timing chain mechanism at the forward end of the engine block.

The free edges of the edge wall 12 is shaped to overlap and engage with the front end of an engine block of a size correlated to the size of the cover. The cover is then fastened to the block by means of screws or bolts which extend through bolt receiving holes 14 and 15 which are cast or otherwise formed in the cover.

The cover may be formed of any suitable metal material. Preferably, it is formed of a die cast aluminum material which may be selected to provide the proper metallurgical qualifications needed. The selection of the particular aluminum material or, correspondingly, steel material, can be accomplished by those skilled in the art, based upon availability, cost, specifications required, etc.

The upper, outer or forward portion of the cover is formed as an upper depressed chamber or depression 17. Water passageways 18 feed water into and around the upper portion of the depression. In addition, a groove 19, provided with a fluid passageway 20 is cast in the upper portion of the cover. Fastener holes of different sizes, that is, small holes 21 and larger holes 22, are cast in the upper portion of the cover. Thus, the engine water circulating equipment or other ancillary equipment may be bolted over the depression. This equipment is not shown since it is conventional.

It should be understood that this improved cover configuration is designed to replace preexisting covers which may be formed in a number of different configurations. The new features described below make this cover improvement somewhat generic in that it can be used instead of a variety of covers. But the cover and many of its parts, without the improvements are known and used on engines.

A tubular or cylindrical formation is integrally formed in the upper portion of the cover wall. This formation 25 provides a means for mounting a distributor mechanism which may extend through the tubular formation into the cavity 13. Significantly, at least two widely separated holes 26 are located adjacent the exterior of the tube formation. These holes are threaded for receiving a screw 27 and, they are angularly spaced apart from each other. Thus, either hole is used, but not both, to accommodate different types of distributors since conventional distributors are formed with mounting flanges of different types. Thus, regardless of the type of distributor, one or another of its bolt-on portions will overlap one of the holes 26 and can be fastened to the cover by the screw 27. When the cover is inventoried, the screw 27 may be threaded into one of the holes 26 so that it is available for use in either hole when desired. This construction eliminates the need of forming different size, shape or types of distributor receiving openings in a cover of this type since one standard opening will suffice for a number of different distribution mechanisms.

Figure 2:
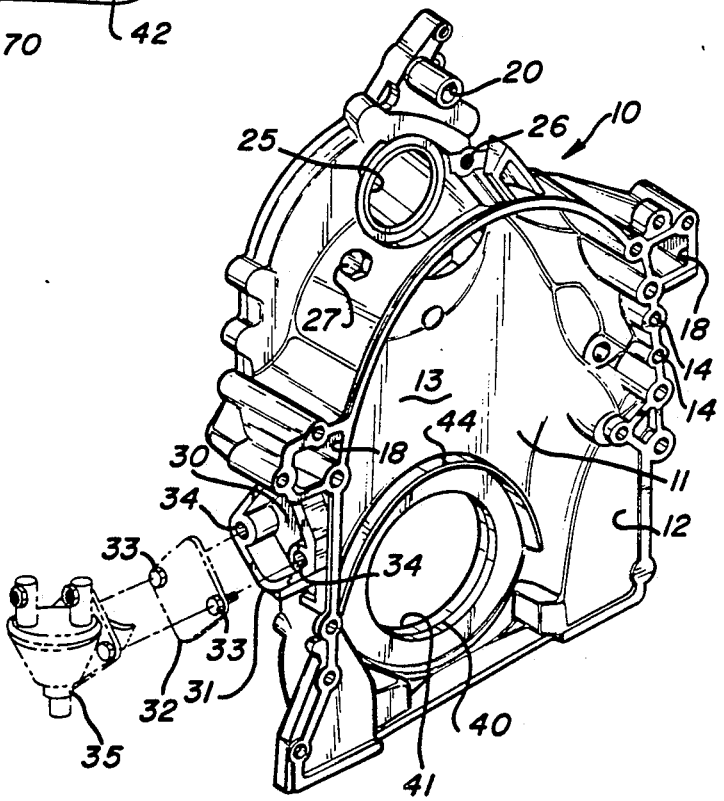
FIG. 2 is a perspective view of the rear of the cover.
Figure 4:
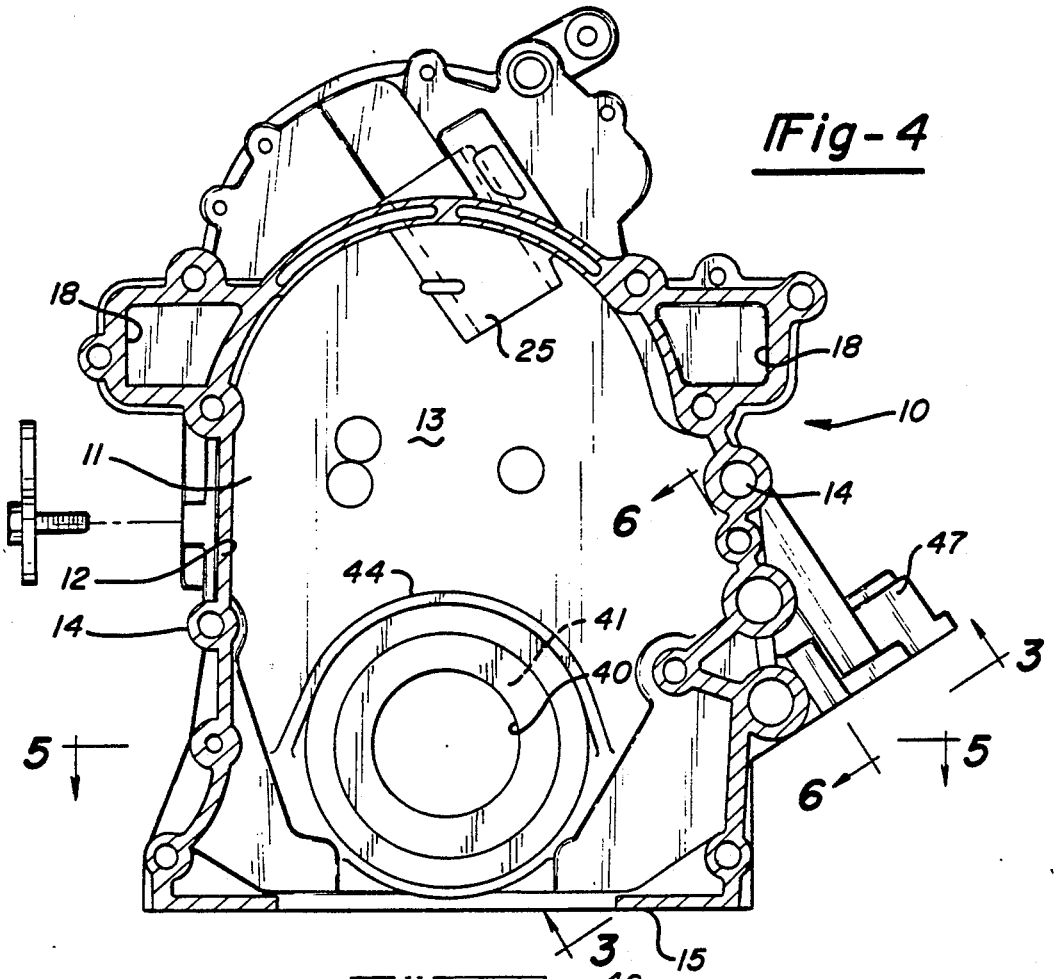
FIG. 4 is an elevational view of the interior, that is, the rear of the cover.
Figure 5:
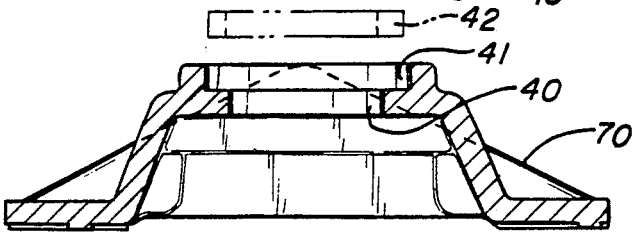
FIG. 5 is a cross sectional view taken in the direction of arrows 5—5 of FIG. 4.

A fuel pump opening 30 is integrally formed on one side of the cover. The opening is surrounded by an integral flange 31 (see FIG. 2) which is normally covered by a flat plate 32. The plate is fastened by screws 33, extending through holes in the plate, into screw receiving sockets 34 formed in the cover.

For some uses, the plate remains tightly in place for sealing or blocking the fuel pump opening. However, in some applications, a fuel pump 35, shown schematically in dotted lines in FIG. 2, may be fastened to the flange 31 by removing the plate 32 and applying the screws 33 through the fuel pump parts. Hence, the cover may be used either with one or another of different types of fuel pumps or, alternatively, the fuel pump opening may be sealed and, instead, the fuel distribution mechanism may be located elsewhere on the engine. By way of example, a fuel injection system may be located on another portion of the engine while the fuel pump opening in the cover is blocked.

The cover overlaps the end of the engine crankshaft. Thus, the cover is provided with a crankshaft opening 40 which is defined by an open, rabbit-type groove 41. The groove opens forwardly and inwardly of the crankshaft opening and receives a seal 42. Because of the groove arrangement, the seal may be moved into the groove, within the confines of the opening 40, while the cover is fastened in place upon the engine. Conversely, the seal may be removed and replaced when desired. Thus, unlike prior devices, wherein the removal of engine forward crankshaft seals require substantial disassembly of the forward portion of the engine and the cover thereon, in this case much of that labor is eliminated.

Figure 3:
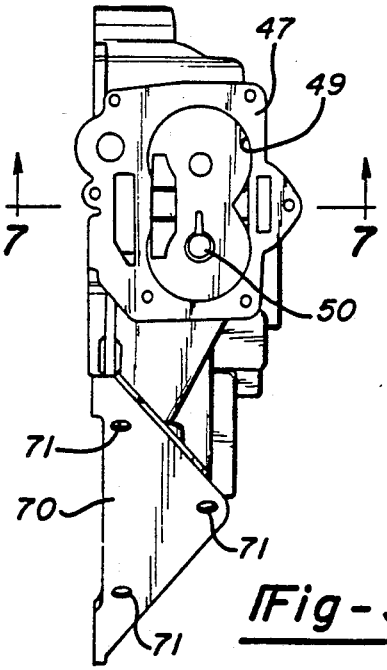
FIG. 3 is a view of the bottom of the cover, taken in the direction of arrows 3—3 of FIG. 4.

FIG. 1 illustrates, in dotted lines, the crankshaft end 43 extending through the seal 42 located in the groove 41 in the crankshaft opening 40. In addition, a half circular lip 44 is integrally formed within the interior of the cover over the crankshaft opening (see FIGS. 2 and 3) for the protection and isolation of the seal and crankshaft end.

On one side, near the lower portion of the cover, an oil pump housing 47 is integrally formed. An oil pump mechanism 48, shown in dotted lines if FIG. 1, is secured to the exterior of the housing portion. This is conventional in construction.

Figure 6:
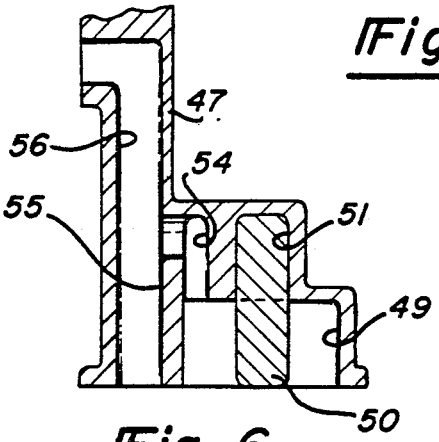
FIG. 6 is an enlarged fragmentary, cross sectional view of the oil pump portion of the housing, taken in the direction of arrows 5—5 of FIG. 4.

The interior of the oil pump housing (see FIG. 3) has a pump impeller cavity 49 which is roughly shaped like a Figure 8 for receiving a pair of gear-like impellers (not shown). A shaft 50 is shown mounted within a socket 51 formed in the housing (see FIG. 6) for mounting one of the gear-like impellers. Although not shown, the impeller would fit over the shaft and in the cavity 49. A passageway 54 communicates with an exit passageway 55 into an oil flow passageway 56 in the housing cover.

Figure 7:
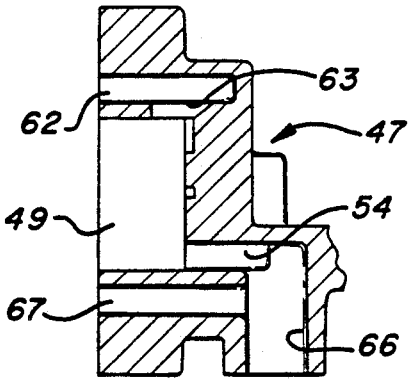
FIG. 7 is an enlarged, fragmentary, cross sectional view of the oil pump housing portion of the cover, taken in the direction of arrows 7—7 of FIG. 3.

As shown in FIG. 7, a passageway 62 leads through an inlet section 63 into the pump cavity 49 and the oil exits through an outlet 54 to two connected port 66 and 67.

The pump housing configuration is conventional, except that the arrangement shown in the cover herein permits enlarging the diameter of the fluid flow passageways so that more fluid than normal may be pumped through the cover and the opening therein, and into attachments, such as tubing or other passageways in the engine, for increasing the rate of flow of oil. Particularly, it is desired that the wall thicknesses of the cover be relatively heavy so as to permit the enlargement of the fluid passageways beyond normal to thereby increase the flow of fluid.

The lower portion of the cover is formed as an integral base 70, which is of a triangular shape. The base is provided with a number of holes 71 which may be threaded. Thus, the base may be applied against the upper lip or flange of a typical oil pan used with an engine and the oil pan may be fastened to the base by screws extending into the screw holes 71. By forming the base in a triangular shape, it is capable of attaching to a number of different shaped oil pans which may be fastened through some, but not all of the holes formed in the base.

In addition to reducing the number of different covers and cover parts required, the cover construction described above provides improvements in the engine assembly. For example, the location of the seal, surrounding the crankshaft, on the outside of the cover and mounted snugly upon the cover insures a better fit and reduces the risk of seal leakage and resulting engine damage. This is particularly desirable in rebuilding or repairing engines where the engines have been worn and thus, may be more susceptible to leakage.

In addition, the construction lends itself to heavier wall sections and increased strength because the cover must be versatile for fitting different engines. Therefore, rather than form the cover with a minimal wall thickness and minimal material, the thickness of the wall forming the cover and the strength of its material may be increased, for universality, resulting in increasing the strength and rigidity for most, if not all, uses of the cover.

It is desired that the foregoing description be read as being illustrative of an operative embodiment of this invention. Thus, this invention may be further developed within the scope of the following claims.

Having fully described an operative embodiment of this invention, I now claim:

1. An internal combustion engine end and timing chain cover for a multi-cylinder, automotive vehicle type engine having a generally horizontally arranged engine block with a forward end and upper and lower portions, and a generally horizontally extending crankshaft with a forward end portion, and a timing chain mechanism on the block forward end above the crankshaft, comprising:

a unitary, cast metal, dish-like, cover having a forward wall surrounded by an integral edge wall shaped to fit over and mount upon the forward end of the engine block with the cover forming an enclosed cavity at the front end of the engine and with the cover cavity adapted to receive and enclose the engine timing chain mechanism portions located on the engine forward end;

said cover having a hole formed in its lower portion in alignment with the engine crankshaft, and with the engine crankshaft forward end portion extending through said hole and being surrounded by a seal;

said seal being mounted within the hole in the cover, within an open, rabbit-like groove surrounding said hole and opening forwardly of the cover, so that the seal may be removed in a forward direction relative to the engine and replaced without removing the cover when the cover is mounted upon the block with the crankshaft extending therethrough;

and bolt receiving openings formed on the cover edge wall through which mounting bolts may be positioned for fastening the cover upon the engine.

2. An engine cover construction as defined in claim 1, and including, said cover having an integral, generally tubular shaped distributor mounting formation with a central opening through said formation, formed in the edge wall of the cover, through which formation a distributor mechanism may be mounted for extending into the cover cavity;

at least two separate, spaced apart screw receiving openings formed in the cover edge wall adjacent said distributor mounting formation and spaced angularly apart relative to each other and the opening in said formation, for alternatively receiving a fastening screw for selectively mounting different types of distributor mechanisms within the central opening of said formation.

3. An engine cover construction as defined in claim 2, and including a fuel pump mounting opening surrounded by a continuous wall-like flange formed in the cover edge wall along one side of the cover and opening into said cover cavity;

and a generally flat plate fitted over said wall-like flange on the outside of the cover and removable mechanical fasteners, such as screws, extending through the plate and fastening the plate to said flange for tightly sealing the fuel pump mounting opening;

and whereby the plate may be removed by removing said fasteners, for mounting a fuel pump on the cover or alternatively, the plate may be left fastened in place and an alternative fuel delivery means, such as a fuel injection system, may be mounted elsewhere upon the engine.

4. An engine cover construction as defined in claim 3, and with the lower edge of the cover having an integral generally horizontal triangular shaped flange formed thereon;

and with screw fastener receiving openings formed in said triangular shaped flange;

whereby the upper edges of different shaped engine oil pans may be fastened to said triangular shaped flange.

5. An engine cover construction as defined in claim 4, and including an oil pump housing portion integrally formed on the cover edge wall near the lower part of the cover for containing oil pump elements;

and passageways extending to and from said pump housing portion through the cover edge wall for conveying pressurized oil through the cover cavity.

6. A timing chain cover useful for mounting upon different model multi-cylinder automotive vehicle type engines for covering the forward end portions of the engine block, with the cover being generally vertically arranged relative to the generally horizontally arranged engine block, and with the engine having a horizontally extending crankshaft with a forward end portion formed for extending through a seal mounted within the lower portion of the cover, and with a timing chain mechanism formed on the engine block forward end above the crankshaft, comprising:

a unitary metal casting formed in a dish-like shape having a forward wall, surrounded by an integral edge wall shaped to overlap and mount upon the forward end of the engine block so that the cover forms and enclosed a cavity over the front end of the engine block, and with the cover cavity adapted to receive and enclose the timing chain mechanism portion located on the engine forward end;

said cover having a crankshaft hole formed in its lower portion in alignment with the engine crankshaft and with the engine crankshaft having a forward end portion extending through said hole and being surrounded by said seal located within said hole;

said seal being mounted within the hole, within an open groove, defining the edge of the hole, with the groove opening forwardly of the cover so that the seal may be removed forwardly of the engine and replaced, without removing the cover, while the shaft is positioned within the cover hole, when the cover is mounted upon the block with the crankshaft extending therethrough;

and an oil pump housing portion integrally formed on the cover edge wall near the lower portion of the cover for containing oil pump elements;

and passageways formed through the cover edge wall leading from the pump housing portion to the cavity and from the cavity to the pump housing portion for conveying pressurized oil through the cover cavity.

7. An engine cover construction as defined in claim 6, and including a fuel pump mounting opening, surrounded by a continuous wall-like flange, formed in the cover edge wall along one side of the cover and opening into the cover cavity;

and a generally flat plate fitted over and covering said wall-like flange and the opening defined thereby, on the outside of the cover, and removable mechanical fasteners, such as screws, extending through the plate and removably fastening the plate to said flange for tightly sealing the fuel pump mounting opening;

and the plate being selectively removable by removing said fasteners for mounting a fuel pump on the cover for extending through the fuel pump opening into the cavity, or alternatively, the plate may be left in place for sealing the opening in the cover and an alternative fuel delivery means may be mounted elsewhere upon the engine.

8. An engine cover construction as defined in claim 6, and including said cover having an integral generally tubular shaped distributor mounting formation having a central opening, formed in the edge wall of the cover, through which a distributor mechanism may be mounted for extending into the cover cavity;

at least two separate, angularly spaced apart screw receiving openings formed in the cover edge wall adjacent said distributor mounting formation for alternatively receiving a fastening screw for selectively mounting different types of distributor mechanisms within the central opening of said formation for extending into the cavity.

9. An engine cover construction as defined in claim 6, and including a generally horizontal triangularly shaped base formed on the lower edge of the cover, integral with the cover casting, and having screw fastener receiving openings formed therein;

whereby the upper edges of different shaped engine oil pans may be fastened to said triangular shaped flange as desired.

10. In an internal combustion engine of a multi-cylinder, automotive vehicle type, having a timing chain on a forward end and a cover removably positioned over the forward end timing chain portions, and having a horizontally extending crankshaft with a forward end portion, an improved cover comprising:

a unitary, cast metal, dish-like shaped cover having a forward wall surrounded by an integral edge wall shaped to fit upon and be fastened to the forward end of the engine block, with a cover forming an enclosed cavity over the front end of the engine, and with the cover cavity adapted to receive and enclose the timing chain mechanism portions located on the engine forward end;

said cover having a hole formed in its lower portion in alignment with the engine crankshaft for receiving the end of the engine crankshaft, and with the engine crankshaft extending through and being surrounded by a seal;

said seal being mounted within said hole, within an open groove defining the edge of said hole and which groove opens towards the center of the hole and forwardly of the hole, so that the seal is fitted within said groove and may be removed in a forwardly direction and replaced within the groove without removing the cover when the cover is mounted upon the engine block with the crankshaft extending therethrough;

said cover having integral, generally tubular shaped distributor mounting formation having a central opening, with the formation formed in the edge wall of the cover, and through which a distributor mechanism may be mounted for entering into the cover cavity;

at least two angularly spaced apart screw receiving openings formed in the cover edge wall adjacent said distributor mounting formations for alternatively receiving a fastening screw for selectively mounting different types of distributor mechanisms within the central opening of said formation;

and a fuel pump mounting opening surrounded by a continuous wall-like flange integrally formed on the cover edge wall along one side of the cover, and opening into the cover cavity;

and a plate fitted over the free edges of said wall-like flangé and being secured thereto by removable mechanical fasteners extending through the plate and said flanges, with the plate tightly sealing and blocking the fuel pump mounting opening;

whereby the plate may be removed by removing said fasteners for mounting a fuel pump on the cover or, alternatively, the plate may be left in place and a different fuel delivery means may be mounted elsewhere upon the engine.

11. An engine cover construction as defined in claim 10, and including the lower edge of the cover having an integral, generally horizontal, triangular shaped base formed thereon, and with the base having fastener receiving openings formed therein in various locations for receiving fasteners for securing the upper edges of different shaped engine oil pans upon said base.

* * * * *